US005855526A

United States Patent [19]

Honma

[11] Patent Number: 5,855,526

[45] Date of Patent: Jan. 5, 1999

[54] GOLF CLUB

[75] Inventor: Yukihiro Honma, Tokyo, Japan

[73] Assignee: Honma Golf Co., Ltd., Tokyo, Japan

[21] Appl. No.: 598,076

[22] Filed: Feb. 7, 1996

Related U.S. Application Data

[63] Continuation of Ser. No. 364,975, Dec. 28, 1994, abandoned.

[30] Foreign Application Priority Data

Jun. 14, 1994 [JP] Japan ..... 6-154354

[51] Int. Cl.[6] ..... H63B 53/02

[52] U.S. Cl. ..... 473/310; 473/345

[58] Field of Search ..... 473/305, 306, 473/307, 308, 309, 310, 311, 312, 313, 314, 315, 324, 345, 346, 349

[56] References Cited

U.S. PATENT DOCUMENTS

| | | | |
|---|---|---|---|
| 1,444,842 | 2/1923 | Lagerblade | 273/80.5 |
| 1,882,509 | 10/1932 | Lagerblade | 273/80.5 |
| 5,028,049 | 7/1991 | McKeighen | 273/167 H |
| 5,335,909 | 8/1994 | Green | 273/80.4 |

FOREIGN PATENT DOCUMENTS

| | | | |
|---|---|---|---|
| 2225726 | 6/1990 | United Kingdom | 273/80.2 |
| 2241173 | 8/1991 | United Kingdom | 273/80.2 |
| 8704634 | 8/1987 | WIPO | 273/80.2 |

*Primary Examiner*—Sebastiano Passaniti
*Attorney, Agent, or Firm*—Beveridge, DeGrandi, Weilacher & Young, LLP

[57] ABSTRACT

A golf club having a head made of metallic material such as aluminum, stainless steel, titanium or the like is provided with a shaft sleeve made of non-metallic material such as fiber reinforced plastic, wood or the like is mounted on a tip end portion of a shaft or a shaft insertion portion of a head with which player's wrists, elbows, shoulders or the like would hardly be damaged, it is easy to enjoy an inherent performance of the shaft, to enhance a repulsive force by a kick back phenomenon to increase a hit distance of the ball.

10 Claims, 1 Drawing Sheet

GOLF CLUB

This application is a continuation of U.S. Pat. No. 08/364,975, filed Dec. 28, 1994, now abandoned.

BACKGROUND OF THE INVENTION

1. Field of the Invention

The present invention relates to a golf club.

2. Prior Art

In a conventional process for producing a golf club provided with a head made of metal material such as aluminum, stainless steel or titanium, a tip end portion of a shaft is directly inserted into a shaft insertion portion of a head and securely fixed thereto with adhesives.

In the prior art, a shock generated in ball impact is not moderated and is transmitted to the player almost without reducing the magnitude of the shock. Thus, in many cases, the wrists, elbows or shoulders of the player might be damaged. Since the tip end portion of the shaft that has been inserted into the head is bound thereby so that it hardly flexes, it is difficult to exhibit the inherent performance of the shaft. In the golf play, the hit distance of the ball depends mainly on an initial velocity of the ball, an angle of the hit ball and a spinning amount of the ball. Also, it is effective to increase the head speed of the club by generating a flexible motion of the tip end portion of the shaft which transmits the energy to the ball to increase the repulsive force. However, such effect could not be expected in the club according to the prior art.

SUMMARY OF THE INVENTION

In view of the foregoing defects, an object of the present invention is to provide a golf club which enables to suppress a shock generated upon the ball impact, and which would hardly damage player's wrists, elbows, shoulders and the like.

It is another object of the invention is to provide a golf club wherein a tip end portion which has been inserted into a head may flex to thereby exhibit an inherent performance of the golf club.

Still another object of the present invention is to provide a golf club which increases a repulsive force to enhance a head speed and to increase a hit distance of the ball by generating a flexible motion of the tip end portion of the shaft.

In order to attain these and other objects, according to the present invention, there is provided a golf club wherein a shaft sleeve made of non-metallic material such as fiber reinforced plastic, wood or the like is mounted on a tip end portion of a shaft.

According to another aspect of the invention, there is provided a golf club wherein a shaft sleeve made of non-metallic material such as fiber reinforced plastic, wood or the like is mounted on a shaft insertion portion of a head.

If the shaft sleeve made of non-metallic material such as fiber reinforced plastic, wood or the like which has a suitable flexibility in comparison with metal is mounted on a shaft insertion portion of a head or a tip end portion of the shaft, by elasticity of the shaft sleeve 2, it is possible to suppress the shock generated upon the ball impact, to flex the tip end portion of the shaft inserted into the head, and to generate a flexible motion at the tip end portion of the shaft to increase the repulsive force thereby enhance the head speed of the club.

The above-described increment of the repulsive force may be explained as a so-called "kick back phenomenon" which may be generated by the provision of the above-described shaft sleeve. Namely, upon the swing of the golf club, the head is momentarily returned back, and at the same time, a large repulsive force is generated at the tip end portion of the shaft so that an acceleration is generated by the repulsive force to increase the head speed. Also, if the tip end portion of the shaft is flexed, the longitudinal gear effect of the club head is remarkable to suppress the generation of the back spin of the ball.

DESCRIPTION OF THE PREFERRED EMBODIMENTS

The present invention will now be described with reference to the accompanying drawings.

Figure 1:
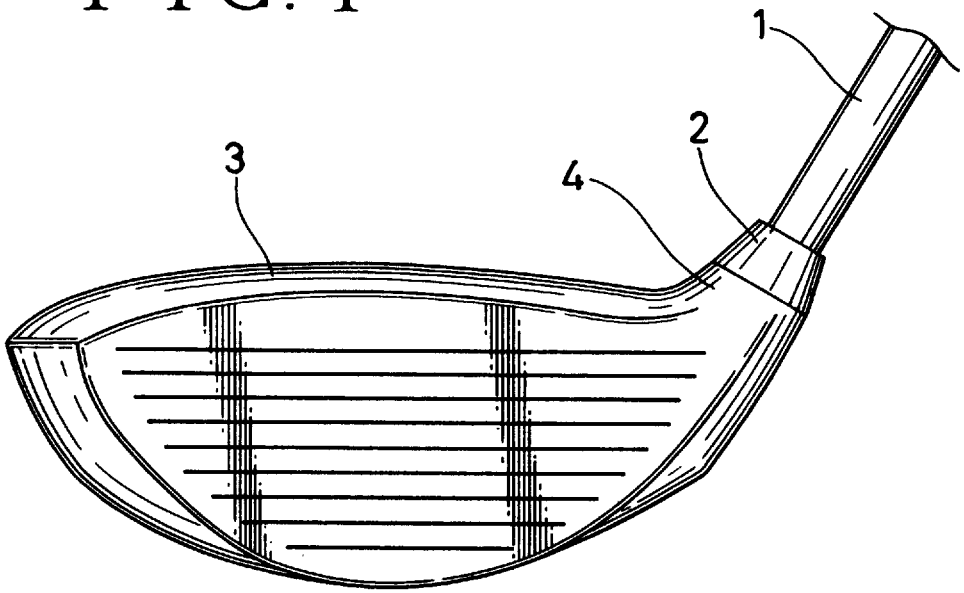
FIG. 1 shows an overall view of the main part of the golf club according to an embodiment of the invention.
Figure 2:
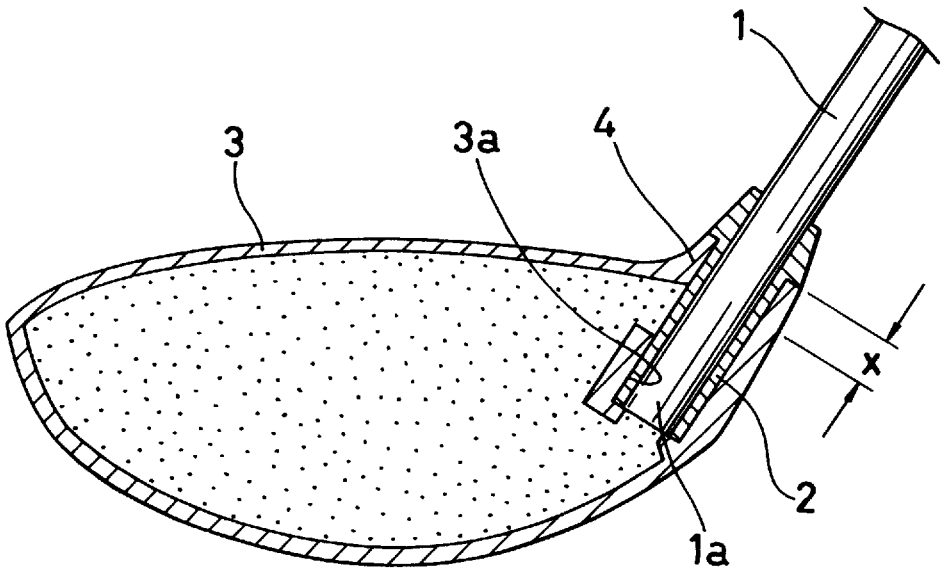
FIG. 2 is a cross-sectional view of the main part shown in FIG. 1.

As shown in FIGS. 1 and 2, a shaft sleeve 2 made of non-metallic material such as fiber reinforced plastic (FRP), wood or the like is securely fitted around a tip end portion 1*a* (i.e., lower end portion) of a shaft 1. The tip end portion 1*a* of the shaft 1 provided with shaft sleeve 2 is securely inserted by threading or adhesives into a shaft insertion portion 3*a* of a metallic head 3 made of aluminum, stainless steel, titanium or the like. A length x of a flange 4 formed integrally with the head 3 is set at a short level. In assembling order, the shaft sleeve 2 is securely inserted first into the shaft insertion portion 3*a* of the head 3 and the tip end portion 1*a* of the shaft 1 may be securely inserted into the shaft insertion portion 3*a* to which the shaft sleeve 2 has been fixed. Incidentally, the shaft sleeve 2 may be fully inserted into the shaft insertion portion 3*a* of the head 3 or otherwise may be partially extruded out of the head 3.

As in the golf club having the structure described above, if the shaft sleeve 2 made of non-metallic material such as fiber reinforced plastic material wood or the like is mounted on the shaft insertion portion 3*a* of the head 3 or the tip end portion 1*a* of the shaft 1, it is possible to moderate a shock generated upon ball impact, by the elasticity of the shaft sleeve 2, to thereby reduce a magnitude of the shock to be transmitted to the player in comparison with the conventional golf club. Thus, the player's wrists, elbows, shoulders and the like would not be damaged. Also, the tip end portion la of the shaft 1 that has been inserted into the head 3 may be flexed together with other parts, the inherent performance of the shaft may readily be exhibited. Also, a flexible motion of the tip end portion 1*a* of the shaft 1 is caused to be generated, thereby increasing the repulsive force to enhance the head speed of the club, resulting in a long hit desitance of the ball.

The fact that shaft 1 is flexed also at the tip end portion 1*a* that has been inserted into the head 3 explains the phenomenon at the tip end portion of the overall flexure. This makes a remarkable difference in magnitude of the flexure of the overall shaft 1 and magnitude of repulsive force. Namely, a so-called "kick back phenomenon" is generated, and more specifically, the head 3 is momentarily returned by the shock of the ball impact, and at the same time, a large repulsive force is generated at the tip end portion 1*a* of the shaft 1. An acceleration is generated by the repulsive force to increase the head speed. As a result, the ball hit distance may be elongated. Also, when the tip end portion 1*a* of the shaft 1 is flexed, a longitudinal gear effect of the club head is remarkable and a so-called back spin would hardly be applied to the ball. Thus, it is possible to elongate the ball hit distance. This effect is further enhanced since the length x of the flange 4 formed integrally with the head is set at a short level.

In order to numerically confirm the above-described kick back phenomenon, the following comparison experiments were conducted. However, since it was difficult to directly measure the head speed accelerated in the moment of the impact, this was replaced by the speed (initial velocity) of the ball in the experiment. The test conditions, items and results of the measurement were shown as follows.

1. Test Conditions
   (1) Head speed of Club (HV): 40 m/s or 45 m/s
   (2) Club Used: BIG-LB Metal (Trade Name of Present Assignee)
   #1 Wood
   Loft Angle 10.5°
   (3) Ball Used: Two-Piece Ball
2. Measurement Items
   (1) Ball Velocity (BV)
   (2) Number of Back Spin (rpm) of the Ball
3. Measurement Results

TABLE 1

| (1) HV: 40 m/s | number of back spin (rpm) | BV (m/s) | BV/HV |
|---|---|---|---|
| no shaft sleeve applied | 2,830 | 58.8 | 1.47 |
| shaft sleeve applied | 2,770 | 59.2 | 1.48 |

TABLE 2

| (1) HV: 45 m/s | number of back spin (rpm) | BV (m/s) | BV/HV |
|---|---|---|---|
| no shaft sleeve applied | 2,920 | 66.2 | 1.47 |
| shaft sleeve applied | 2,810 | 67.1 | 1.49 |

As shown in Tables 1 and 2, the speed of the ball of the golf club of "shaft sleeve applied" where the shaft sleeve 2 made of non-metallic material such as fiber reinforced plastic, wood or the like was mounted on the shaft was faster than the conventional club of "no shaft sleeve applied" and the number of back spins according the present invention was more suppressed than that of the conventional club. Also, in the club of "shaft sleeve applied", the advantage was more remarkable in the case of higher head speed than in the case of lower head speed.

The present invention offers the following advantages.

According to the present invention, since the shaft sleeve made of non-metallic material such as fiber reinforced plastic, wood or the like is mounted on the shaft insertion portion of the head or the tip end portion of the shaft to suppress the shock generated upon the ball impact, the wrists, elbows, shoulders or the like of the player would hardly be damaged. Accordingly, it is possible to provide a golf club which may readily be used by anybody. Also, since the tip end portion of the shaft which has been inserted into the head may flex together with the other parts, it is easy to enjoy the inherent performance of the shaft. Therefore, it is possible to provide a high performance golf club which may sufficiently exhibit the inherent performance of the shaft. Also, since the tip end portion of the shaft may take a flexible motion to generate the kick back phenomenon to increase the repulsive force, it is possible to enhance the head speed of the club to increase the hit distance of the ball. In this sense, it is possible to provide a high performance golf club.

What is claimed is:

1. A golf club wherein an elastic shaft sleeve made of a non-metallic material selected from the group consisting of fiber reinforced plastic and wood is mounted on a shaft insertion portion of a head wherein the sleeve abuts an opening of a flange, said shaft insertion portion extending into said head, wherein a distal end of a shaft is inserted into a terminal end of said shaft sleeve wherein the sleeve flexes to generate a repulsive force upon the head striking a ball.

2. A golf club, comprising:

a metallic club head defining a metallic shell incorporating a top side end and a ball contacting face and a shaft insertion opening having a selected depth of selected dimensions formed in said top side end, a flange integrally associated with said metallic club head at said top side end and about said shaft insertion opening, a shaft with a distal end and a proximal end, and a shaft sleeve formed from a flexible non-metallic material selected from the group consisting of fiber reinforced plastic and wood, said shaft sleeve being mounted in said shaft insertion opening in a manner to abut said flange, said shaft sleeve being sized and configured to register within said shaft insertion opening and adapted to receive and secure said distal end of said shaft upon insertion thereof into said shaft sleeve, wherein transition of shock impact forces from the club head to the shaft upon contact between the face of the club head with the ball are reduced.

3. A golf club according to claim 2 wherein the golf club head is formed from a metal selected from the group consisting of aluminum, stainless steel and titanium.

4. A golf club according to claim 2 wherein said shaft sleeve causes the ratio of the ball velocity to golf club head velocity to exceed 1.47 at a club head speed of a least 40 m/s.

5. A golf club according to claim 4 wherein said shaft sleeve causes the back spin of the ball to be reduced by at least 1%.

6. An impact force reducing golf club, comprising:

a shaft formed from metal with a tip end portion and a gripping portion;

a golf club head formed of a metal shell including a top side end formed from a metal selected from the group consisting of aluminum, stainless steel and titanium, said golf club head having formed therein a shaft insertion portion and a flange on the top side end of the golf club head, said shaft insertion portion being separated from said flange in an axial direction;

a non-metallic sleeve insert configured to be securely inserted into said shaft insertion portion and sized to receive said shaft tip end for securing said shaft to said head;

wherein said sleeve insert moderates and reduces the magnitude of shock impact generated by ball impact and increases the golf club head speed by providing flexible motion to generate a repulsive force at the shaft tip end and to suppress generation of back spin of the ball upon impact.

7. A golf club according to claim 6 wherein the shaft sleeve is formed material selected from the group consisting of fiber reinforced plastic and wood.

8. A golf club according to claim 7 wherein said sleeve insert causes the ratio of the ball velocity to golf club head velocity to exceed 1.47 at a club head speed of a least 40 m/s.

9. A golf club according to claim 7 wherein said sleeve insert causes the ratio of the ball velocity to golf club head velocity to be at least 1.48 at a club speed of a least 40 m/s.

10. A golf club according to claim 9 wherein said sleeve insert causes the back spin of the ball to be reduced by at least 1%.

* * * * *